US006490967B1

(12) United States Patent
Hovda

(10) Patent No.: US 6,490,967 B1
(45) Date of Patent: Dec. 10, 2002

(54) ARRANGEMENTS IN A PRESSING APPARATUS FOR FOLDING CARDBOARD BOXES AND CONTAINERS, AS WELL AS USE OF SUCH A PRESSING APPARATUS

(76) Inventor: Olav Hovda, Fogn (NO), N-4164

( * ) Notice: Subject to any disclaimer, the term of this patent is extended or adjusted under 35 U.S.C. 154(b) by 0 days.

(21) Appl. No.: 09/423,005

(22) PCT Filed: Apr. 22, 1998

(86) PCT No.: PCT/NO98/00129

§ 371 (c)(1),
(2), (4) Date: Oct. 29, 1999

(87) PCT Pub. No.: WO98/51484

PCT Pub. Date: Nov. 19, 1998

(30) Foreign Application Priority Data

Apr. 30, 1997 (NO) ..... 972005

(51) Int. Cl.[7] ..... B30B 13/00
(52) U.S. Cl. ..... 100/35; 100/233
(58) Field of Search ..... 100/233, 234, 100/236, 902, 35

(56) References Cited

U.S. PATENT DOCUMENTS

| | | | | | |
|---|---|---|---|---|---|
| 44,742 | A | * | 10/1864 | Parham | 100/233 |
| 525,803 | A | * | 9/1894 | White | 100/233 |
| 750,354 | A | * | 1/1904 | Wetzler | 100/233 |
| 2,037,553 | A | * | 4/1936 | Wagner | 100/233 |
| 2,373,057 | A | * | 4/1945 | Shinn | 100/233 |
| 2,800,160 | A | * | 7/1957 | Wilson et al. | 100/233 |
| 3,237,554 | A | * | 3/1966 | Davis, Jr. | 100/233 |
| 3,776,129 | A | * | 12/1973 | Carlson | 100/233 |
| 4,058,054 | A | | 11/1977 | Markman | |
| 4,333,397 | A | * | 6/1982 | Modes | 100/233 |
| 4,586,643 | A | * | 5/1986 | Halabisky et al. | 229/3.1 |
| 5,507,222 | A | * | 4/1996 | Reavey | 100/233 |

FOREIGN PATENT DOCUMENTS

| | | | | |
|---|---|---|---|---|
| CH | 210557 | | 7/1949 | |
| DE | 4139282 | A1 * | 11/1991 | 100/902 |
| DE | 41 39 282 | | 5/1992 | |
| DE | 4402880 | A1 * | 2/1994 | 100/902 |
| DE | 44 02 880 | | 9/1994 | |
| EP | 0512504 | A2 * | 5/1992 | 100/902 |
| EP | 089399 | | 9/1993 | |

* cited by examiner

*Primary Examiner*—Stephen F. Gerrity
*Assistant Examiner*—Louis Huynh
(74) *Attorney, Agent, or Firm*—Andrus, Sceales, Starke & Sawall, LLP

(57) ABSTRACT

A folding method for empty disposable packages, e.g. milk cartons, permitting reuse collection in suitable physical standards, as well as a device for this purpose. A bottom plate (3) firmly cooperates with two longitudinal, upright, identical sidewalls, one at each side, between which a pressing plate (1) is led downwardly. The opening portion of an empty milk carton placed beneath said pressing plate between the sidewalls will be closed first. The carton is placed on the base plate with a glued bottom seam oriented vertically. Air within the carton will be compressed and exert an internal pressure against the bottom side, which will be blasted outwardly and deformed, before the air escapes through the opening portion. The thickness of such a compressed carton allows twenty empty cartons to be inserted into one, which is 50% more than normal. The pressing plate (1) of the device is hinged between the lower and outer part of the sidewalls, so that a directed pressing plate (1) will do the folding function.

1 Claim, 7 Drawing Sheets

ARRANGEMENTS IN A PRESSING APPARATUS FOR FOLDING CARDBOARD BOXES AND CONTAINERS, AS WELL AS USE OF SUCH A PRESSING APPARATUS

CROSS REFERENCE TO RELATED APPLICATIONS

This application is a National Stage filing under 35 U.S.C. §371 of International Application No. PCT/NO98/00129, which has an international filing date of Apr. 22, 1998 and which designated the United States of America.

BACKGROUND OF THE INVENTION

The invention relates to a folding method for empty disposable packages, e.g. milk cartons allowing reuse collection in suitable physical standards, and a device for the purpose.

Transition to use of standardized disposable packages has developed strongly in modem time and contributed to a well arranged flow of goods from the producer through the trade links to the consumer. The producers have achieved a very rational production process; storage and transport are based on a consistent standardization of the physical measures of trade and consumer units, simultaneously, requirements to hygienics can be taken care of in a controllable way. The distribution channels have derived great advantages through this transition to standardized disposable package, and it is difficult to imagine a reversed development, even if, from a social point of view, valuable material is occupied which, after one time's use, has ended its function when surrounding the primary product for a relatively short period.

Such disposable packages have to an increasing degree flooded the consumer society, and given us a waste problem of large dimensions. The waste has simultaneously assumed a constantly more superior form, as highly developed products having a high raw material value and maybe large volume, after a short time's use as package, nevertheless will represent a problem, even if the individual components thereof are in fact a raw material resource.

In order to define such a used package resource as such, it is decisive to separate therefrom other waste and other raw materials. All waste recovery is, in principle, based on separation, thus removing the individual components from the collected mass in a secure and cheap way, preferably without hired labour.

On account of the foregoing, the term "source sorting" has arose; it is important that the consumer himself/ herself makes the separation of the individual components valuable enough to take care of, as seen from the society's point of view and, likewise, that the society organizes and takes the necessary steps for collection and reuse of the sorted out raw materials, so that a sensible cooperation between consumer, who takes care of the sorting work, and the society, seeing the utilitarian value.

By means of pledging arrangements and automatic receipt, standard bottles are recovered through the same trade links as those selling the products in the first instance. other glass of non-standard quality is collected in container systems. Accumulator batteries containing environmental poison are assigned their own arrangements, etc. Normal household waste is today sorted by consumer into two or three fractions, of which clean paper for reuse has become the largest variant. Some places, clean organic waste is sorted from the collected waste for municipal compost heaps. Remaining garbage is characterized as rubbish, and is buried on municipal refuse dumps.

In this last rubbish fraction are found, e.g. both high grade aluminum cans as well as plastics of very mixed origins having various chemical properties. Additionally, a consumer normally transfers also all kinds of juice and milk cartons to this rubbish fraction.

Juice cartons may have the same measures as milk cartons, but may also have very different external measures. Moreover, such cartons are internally foliated with aluminum, which becomes a disturbing factor upon reuse. It is, however, not excluded that the present method, taking a long view, also may be used in connection with such juice cartons.

Standard milk cartons are made from virgin, non-recirculated wooden fibres of very high quality. The mass price for such fibres are among the very highest paid prices in the market thereof.

These cartons having exactly the same standard measures, are coated with plastic both internally and externally in order to give the milk the protection required to maintain taste and hygienics, and they are, therefore, a very high grade, but expensive package, as seen relatively.

Much work has been carried out in order to achieve a satisfactory return arrangement for these milk cartons, both because of the value they actually represent, but also because the volume constitutes a large part of the waste and increases the need for refuse dumps and the care thereof.

Return arrangements have i.a. failed on the account of cleaning the milk cartons through rinsing which can not be expected to be carried out satisfactorily. The main reason, however, is that up to now there has not been available technology on the market to separate the approximately 12% of plastics coating the external side faces of the carton, from the cardboard material of the carton.

SUMMARY OF THE INVENTION

The present folding method enables collection for reuse purpose in suitable physical standards of e.g. milk cartons in that the invention relates to a manual special folding device.

Now, in Norway, refined and expensive U.S. technology has been installed. Through an advanced process the foregoing object is achieved, not only resulting in that clean cardboard fibres are separated out, but also in that the plastics used, having as high a burning value as petrol, become separated out and may be used to drive the process.

Today, this technology requires large plants in order to obtain a sensible economy, but the likelihood of reducing the size of these plants is large.

There has been initiated smaller collection campaigns for milk cartons, i.a. in the Oslo region and in Rogaland, and the possibilities for reuse seen gradually to be revealed in our country also.

On the European continent, approximately 800,000 tons of milk and juice cartons constitute the annual tonnage which up to now has been buried on refuse dumps.

In Rogaland, the annual production is approximately 45 million milk cartons, each weighing 28 grams.

For the whole country, the production of the dairies is somewhere between 700 and 800 million units or approximately 22,400 tons.

From the patent literature, i.a. the following is known:

U.S. Pat. No. 2,800,160 discloses a device for clamping together empty tins and the like. The deforming compression is achieved by means of a hinged and rotary face which is clamped against a fixed support, thus reducing the volume of the tins, but the clamped body has no standard shape suited for any kind of joining or stacking.

Likewise, the U.S. patent specification discloses a more assembled device which, with a pivotal pressing face against a fixed support, upon a first pressing operation folds the tin and, thereafter, by turning the folded tin right-angled, compresses the tin with a new pressing operation, but the compressed body has no standard shape suited for stacking or other joining of a plurality of such bodies.

EP 0 089 399 discloses a manual press for use in the making of a briquette-shaped fuel material of primarily moistened newspaper, disposed in a box-shaped body having a corresponding face subjected to manual compression by means of a pivotal pressing arm. Obviously, the purpose is not to fold or press or clamp together disposable package to any form of standard units.

DETAILED DESCRIPTION OF THE INVENTION

The present folding method enables collection for reuse purpose in suitable physical standards of e.g. milk cartons in that the invention relates to a manual special folding device.

BRIEF DESCRIPTION OF THE DRAWING

The present invention is disclosed in the accompanying drawing and following detailed description. In the drawing.

DETAILED DESCRIPTION OF THE INVENTION

Figure 6:
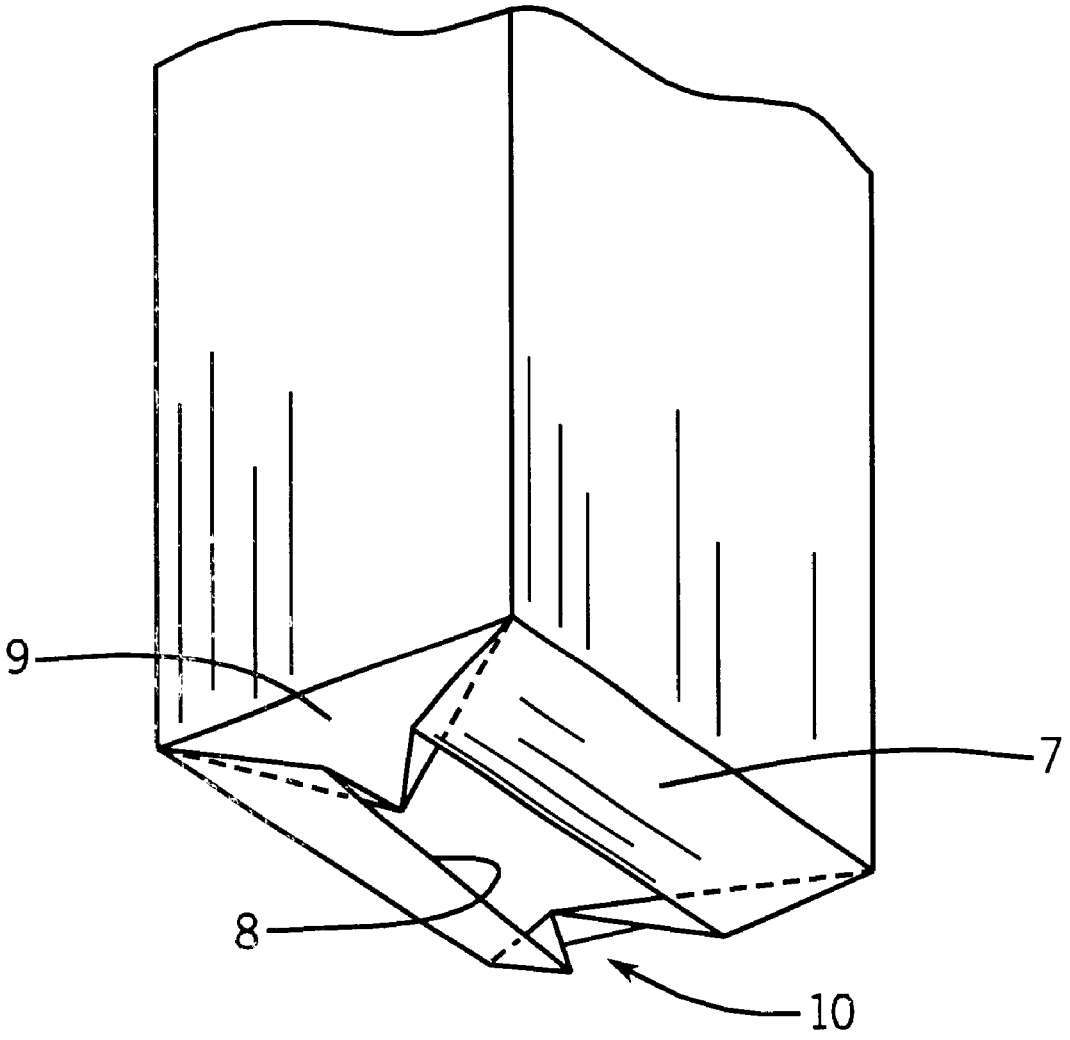
FIGS. 6, 7, and 8, show details of a cardboard carton that can be pressed by the apparatus and method of the present invention.
Figure 7:
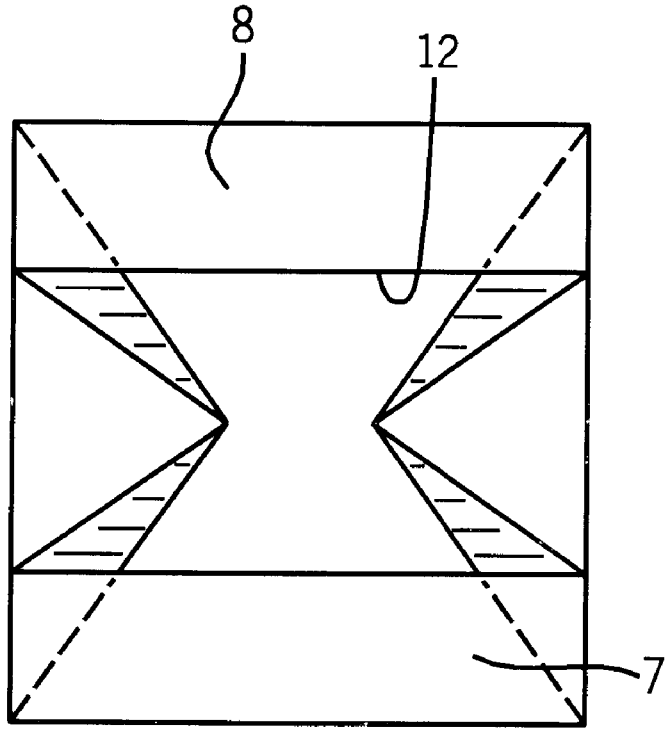
Figure 8:
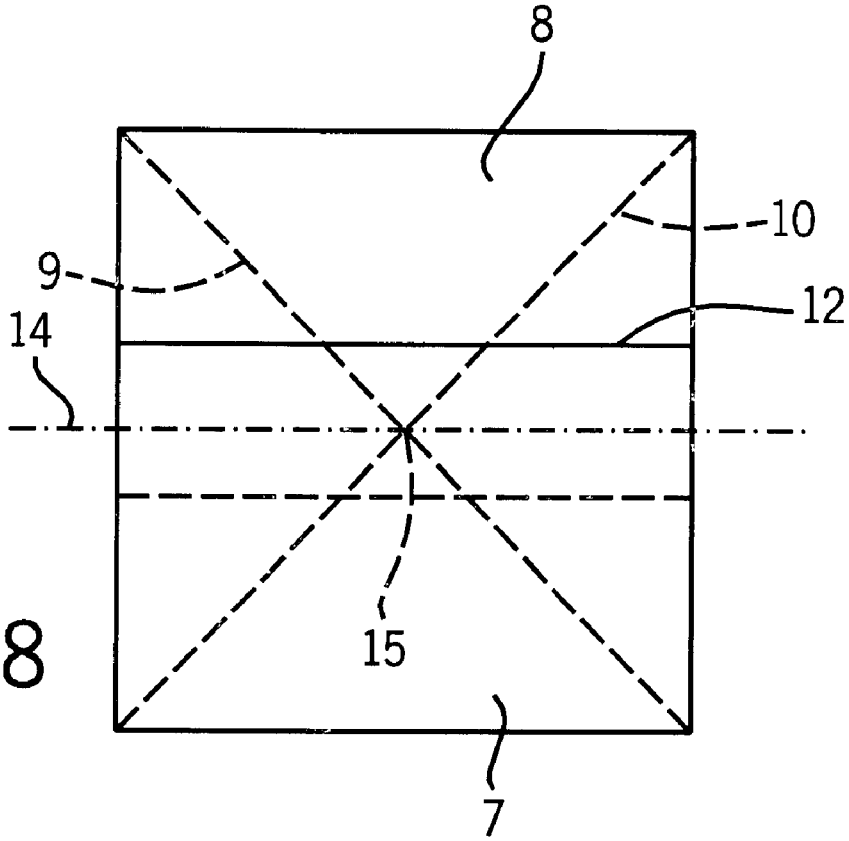

The present invention is suitable for pressing an empty liquid product, constructed as shown in FIGS. 6, 7, and 8. Such a cardboard carton is formed a rectangular tube of panels having an end portion that comprises two opposing triangularly formed fields 9, 10, one corner of one of the fields meeting a comer of the other of the fields at the center of the bottom, as shown in FIG. 8. Rectangular fields 7, 8 are joined to fields 9, 10 and folded and sealed to the bottom. As shown in FIG. 8, the edges 12 of fields 7 and 8 lie parallel to each other and to a center line 15 of the bottom.

Figure 1:
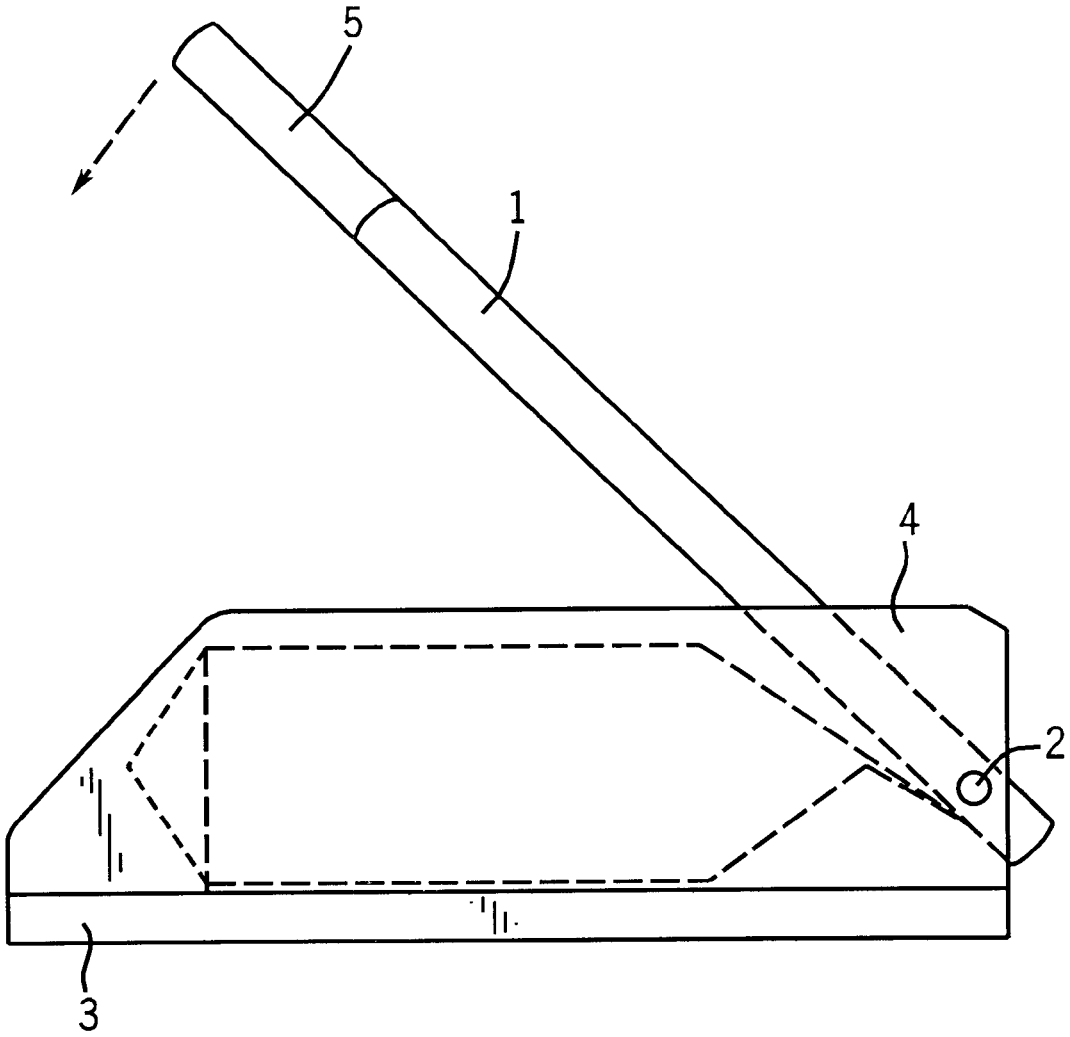
FIG. 1 shows a side view of the device, with portions shown in phantom.
Figure 2:
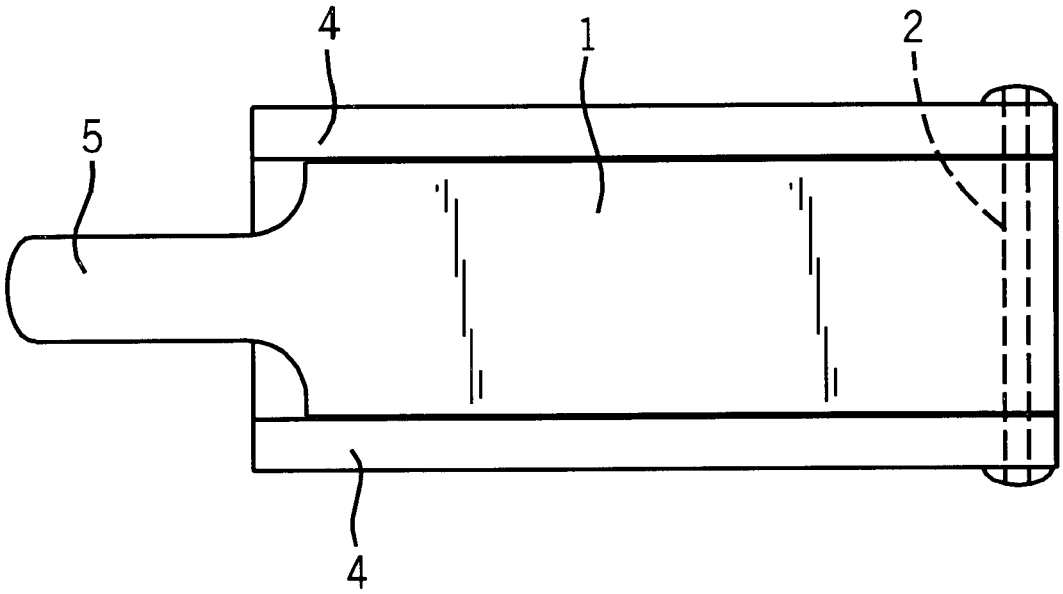
FIG. 2 is a top view of the device of the present invention.
Figure 3:
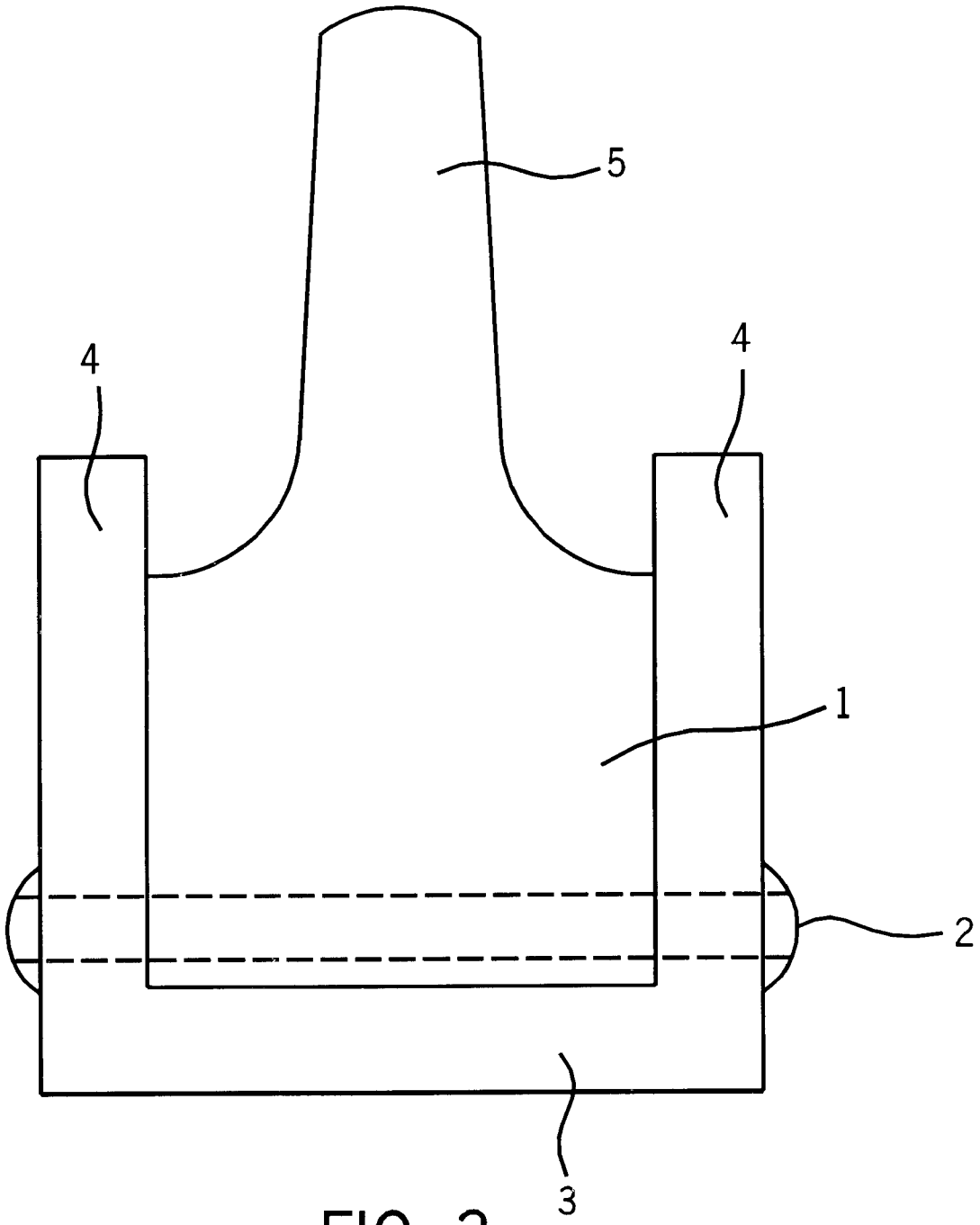
FIG. 3 is an end view of the device of the present invention taken from the right side of FIG. 1.
Figure 4:
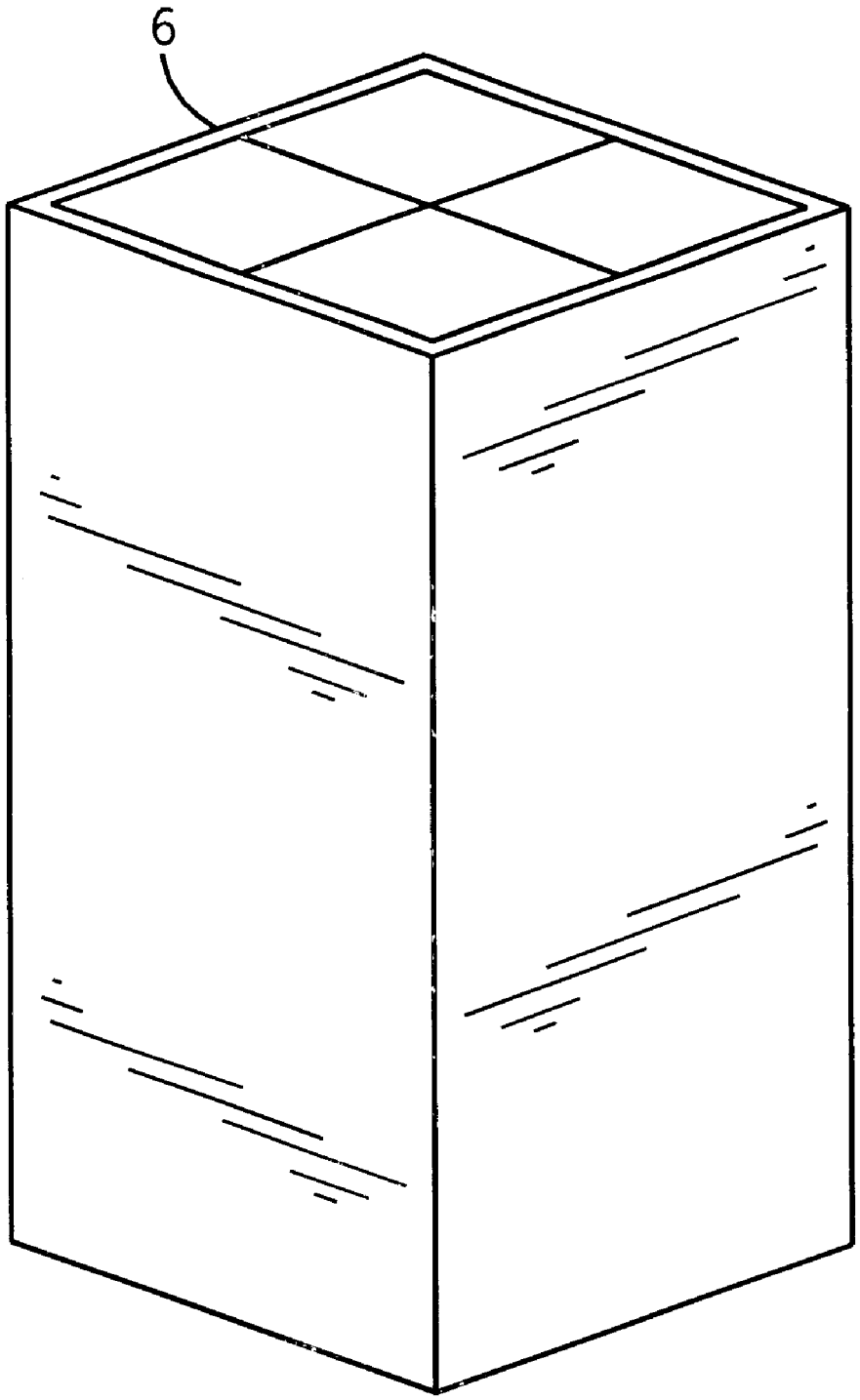
FIG. 4 shows a household collector for compressed cartons.
Figure 5:
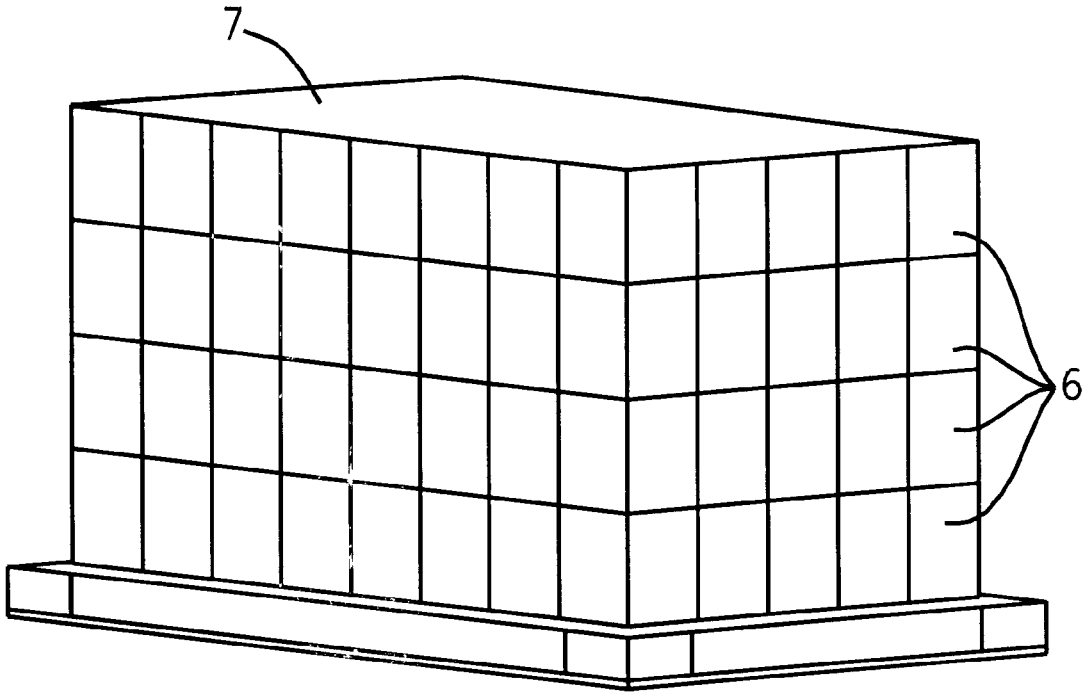
FIG. 5 shows a pallet load of the collectors shown in FIG. 4.

FIG. 1 shows a device, an empty milk carton being placed therein; the opening facing towards the pressing member's 1 fastener at a through bolt 2 in the U-shaped frame part.

The frame part's bottom plate 3 is firmly attached at each side thereof to identical upright sidewalls 4 the mutual spacing thereof only to a small extent exceeding the width of a standard milk carton. E.g., the frame part may be made of extruded aluminum.

Through the lower and outer portion of both sidewalls 4, a hole has been drilled for the passage of a hinge bolt 2, also extending through a drilled hole in the pressing member 1 carrying a handle 5.

The pressing member 1 with handle 5 is formed or e.g. hard wood, aluminum or of combination of other suitable material, and has a shape and a thickness withstanding the forces it shall exert against a milk carton, in order to achieve the deforming folding of the carton, as well as the forces to which the material around the bolt 2 are subjected.

The pressing member's 1 width dimension is only to a little degree smaller than the spacing between the inner side faces of the sidewalls 4.

From the producers, a milk carton is made through gluing together the bottom in a lateral orle or seam. This orle or seam shall always be turned to a vertical position before the carton with its opened top part is passed into the device, down between the sidewalls 4 and forward to the bolt 2.

When the pressing member 1 is forced down manually, the open portion will first receive the pressure and, thereby, close. Upon a further downwardly directed pressure of the pressing member 1 against the bottom plate 3 serving as abutment, a compression of the carton will take place, simultaneously as air within the carton, at first will exert an internal pressure i.a. against the bottom side, which is pressed out and deformed to a triangular point, before the air is let out through the opening.

This pressing out and deforming of the bottom section result in that the compressed carton exhibits such a thickness that twenty such units might be inserted into one empty non-compressed carton, the ordinary number being ten units.

If the carton is inserted into the device erroneously i.e. bottom orle or seam extending horizontally, such a triangular point can not be pressed out.

On the contrary, such an erroneously compressed carton may be stretched manually, and be placed correctly, bottom orle or seam pointing vertically, and it is then possible to obtain the correct triangle pressing out. bottom orle pointing Vertically, and it is then possible to obtain the correct triangle blasting.

Four emptied cartons each filled with twenty compressed cartons are, thereafter, placed into a household collector 6 made of the same fibre quality with e.g. four standing which will then, together contain eighty-four cartons, weighing approximately 2,4 kilograms.

On a wooden fibre pallet 7 having standard measures, it will be possible to stack one layer containing 8×5 units, and with four layers a pallet will carry 13,440 empty milk cartons, weighing approximately 385 kilograms.

With e.g. twenty-four pallets 7 on a car, it will convey 322 560 cartons, weighing approximately 9,2 tons.

All pallets from any municipality will contain the same number and have the same dimensions, permitting stacking upon storage and transport to recirculation plant by car, train or ship, if desirable.

Transferred to standard pallets, the Rogaland Dairy's annual production will constitute approximately 210 full trucks, the corresponding production of Norway being of the order of 3200 full trucks or approximately 22,400 tons.

What is claimed is:

1. A method for compressing parallelepipedal cardboard cartons for liquid products, the carton having a plurality of opposing panels forming sides of the carton, the carton further having a top and a bottom, the bottom being comprised of two opposing, triangularly shaped panels, a corner of one of the triangularly shaped panels meeting a corner of the other triangularly shaped panel at the center of the bottom, said bottom further comprising a pair of opposing rectangular panels joined to said triangularly shaped panels by gussets and folded over said triangularly shaped panels and gussets, the panels of the bottom being sealed together on the bottom of the carton, said rectangular panels presenting termination edges that lie parallel to each other and to an imaginary center line of the bottom, said method comprising the steps of:

providing a press having a planar, elongated base plate, two spaced sidewalls attached to the base plate, and an elongated smooth pressing plate;

placing the carton on the planar, elongated base plate by laying one of the panels on the base plate to orient the imaginary center line of the bottom normal to the base plate, two of the panels being normal to the base plate and defining a lateral dimension for the carton, the carton being surrounded on two sides by sidewalls lying along the two panels of the carton so that said two panels of the carton are contiguous to the sidewalls and the sidewalls closely embrace the carton, the sidewalls extending to a level at least corresponding to the level of the panel of the carton opposite that lying on the base plate when the carton is in an uncompressed condition;

applying the elongated smooth pressing plate to the carton, the pressing plate having an end which is pivotally mounted with respect to the base plate at a fixed pivot axis extending normal to the sidewalls, the carton being placed on the base plate so that the top of the carton is adjacent the pivot axis; and arcuately moving the pressing plate toward the base plate to compress the carton against the base plate, so that the compressing of the carton commences at the top of the carton to restrict air flow at the top of the carton, further compression of the carton as arcuate movement of the pressing plate continues generating air pressure within the carton that causes the triangularly shaped panels to become unsealed and blow outwardly allowing the two panels of the carton contiguous to the sidewalls to collapse to compress the carton, the sidewalls limiting lateral expansion of the carton during compression so that the lateral dimension of the carton in the compressed state is essentially the same as the lateral dimension of the carton when it was in the uncompressed state, the pivotal mounting of the pressing plate being at a height above the base plate that enables the carton to be compressed to the desired dimension when the arcuate movement of the pressing plate toward the base plate is complete.

* * * * *